US011655549B2

(12) United States Patent
Shimada et al.

(10) Patent No.: US 11,655,549 B2
(45) Date of Patent: May 23, 2023

(54) CARBON DIOXIDE TREATMENT APPARATUS, CARBON DIOXIDE TREATMENT METHOD, AND METHOD FOR PRODUCING CARBON COMPOUND

(71) Applicant: HONDA MOTOR CO., LTD., Tokyo (JP)

(72) Inventors: Yuta Shimada, Wako (JP); Hiroshi Oikawa, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 17/671,627

(22) Filed: Feb. 15, 2022

(65) Prior Publication Data

US 2022/0307145 A1 Sep. 29, 2022

(30) Foreign Application Priority Data

Mar. 23, 2021 (JP) ..... 2021 -048648

(51) Int. Cl.
*C25B 3/26* (2021.01)
*C25B 9/19* (2021.01)
(Continued)

(52) U.S. Cl.
CPC ..... *C25B 3/26* (2021.01); *C25B 3/03* (2021.01); *C25B 9/19* (2021.01); *C25B 9/67* (2021.01); *C25B 13/00* (2013.01)

(58) Field of Classification Search
CPC ..... C25B 3/25–3/26
See application file for complete search history.

(56) References Cited

U.S. PATENT DOCUMENTS

2010/0084280 A1* 4/2010 Gilliam ..... C01B 32/60 205/555
2010/0116683 A1* 5/2010 Gilliam ..... C25B 1/04 204/252

(Continued)

FOREIGN PATENT DOCUMENTS

JP 2017-020094 1/2017
JP 2017-031467 2/2017

(Continued)

OTHER PUBLICATIONS

Japanese Notice of Allowance for Japanese Patent Application No. 2021-048648 dated Aug. 30, 2022.

*Primary Examiner* — Harry D Wilkins, III
(74) *Attorney, Agent, or Firm* — Amin, Turocy & Watson, LLP

(57) ABSTRACT

A carbon dioxide treatment apparatus, a carbon dioxide treatment method, and a method for producing a carbon compound that have high energy efficiency in recovery and reduction of carbon dioxide and are highly effective in reducing loss of carbon dioxide. The carbon dioxide treatment apparatus (100) includes a recovery device (1) configured to recover carbon dioxide, an electrochemical reaction device (2) configured to electrochemically reduce carbon dioxide, and a pH adjuster (52), wherein pH of a cathode side electrolytic solution is higher than that of an anode side electrolytic solution, carbon dioxide gas is supplied from a concentration part 11 to a gas flow path on a side of a cathode (21) opposite to an anode (22), and the carbon dioxide gas is reduced at the cathode (21).

20 Claims, 5 Drawing Sheets

(51) Int. Cl.

| | |
|---|---|
| ***C25B 13/00*** | (2006.01) |
| ***C25B 3/03*** | (2021.01) |
| ***C25B 9/67*** | (2021.01) |

(56) References Cited

U.S. PATENT DOCUMENTS

| | | | | |
|---|---|---|---|---|
| 2013/0175181 | A1* | 7/2013 | Kaczur | C25B 3/23 205/345 |
| 2018/0274109 | A1* | 9/2018 | Kudo | C25B 1/04 |
| 2019/0078222 | A1* | 3/2019 | Baldauf | C25B 15/08 |
| 2020/0149170 | A1* | 5/2020 | Hanebuth | C25B 3/25 |
| 2020/0378015 | A1* | 12/2020 | Hanebuth | C25B 9/19 |
| 2022/0274061 | A1* | 9/2022 | Oikawa | C07C 2/08 |

FOREIGN PATENT DOCUMENTS

| | | | |
|---|---|---|---|
| JP | 2017-0311467 | | 2/2017 |
| JP | 2019-183286 | | 10/2019 |
| WO | 2018/232515 | | 12/2018 |
| WO | WO-2022184905 | A2 * | 9/2022 |
| WO | WO-2022263316 | A1 * | 12/2022 |

* cited by examiner

CARBON DIOXIDE TREATMENT APPARATUS, CARBON DIOXIDE TREATMENT METHOD, AND METHOD FOR PRODUCING CARBON COMPOUND

CROSS-REFERENCE TO RELATED APPLICATION

This application claims priority from Japanese Patent Application No. 2021-048648, filed on Mar. 23, 2021, the content of which is incorporated herein by reference.

BACKGROUND OF THE INVENTION

Field of the Invention

The present invention relates to a carbon dioxide treatment apparatus, a carbon dioxide treatment method, and a method for producing a carbon compound.

Description of Related Art

A technology for recovering carbon dioxide in exhaust gas and the atmosphere and electrochemically reducing the recovered carbon dioxide to obtain valuable resources is a promising technology that has the potential to achieve carbon neutrality, but economic efficiency is the biggest issue. In order to improve the economic efficiency, it is important to improve energy efficiency and to reduce loss of carbon dioxide in the recovery and reduction of carbon dioxide.

As a technology for recovering carbon dioxide, a technology in which carbon dioxide in a gas is physically or chemically adsorbed in a solid or liquid adsorbent and then desorbed by energy such as heat is known. Further, as a technology for electrochemically reducing carbon dioxide, a technology in which a carbon dioxide gas is supplied from the side opposite to a catalyst layer of a gas diffusion layer to a cathode having a catalyst layer formed on the side in contact with an electrolytic solution of the gas diffusion layer using a carbon dioxide reduction catalyst and is then electrochemically reduced is known (WO 2018/232515 A1 (Patent Document 1)).

SUMMARY OF THE INVENTION

Carbon dioxide reduction is a promising technology that has the potential to achieve carbon neutrality, but the economic efficiency is the biggest issue. In order to improve the economic efficiency, it is important to recover carbon dioxide efficiently and to convert the carbon dioxide without loss.

One of causes of energy loss in carbon dioxide electrolysis is generation of hydrogen by water electrolysis which is a side reaction that does not involve a desired carbon dioxide reduction reaction. According to a deterioration state of a catalyst in each of the cathode and the anode, the generation of hydrogen may not be able to be suppressed simply by controlling a voltage.

An object of the present invention is to provide a carbon dioxide treatment apparatus, a carbon dioxide treatment method, and a method for producing a carbon compound that have high energy efficiency in recovery and reduction of carbon dioxide and are highly effective in reducing loss of carbon dioxide.

The present invention has adopted the following aspects.

(1) A carbon dioxide treatment apparatus according to one aspect of the present invention (for example, a carbon dioxide treatment apparatus (100) of an embodiment) includes a recovery device (for example, a recovery device (1) of the embodiment) configured to recover carbon dioxide, an electrochemical reaction device (for example, an electrochemical reaction device (2) of the embodiment) configured to electrochemically reduce carbon dioxide, and a pH adjuster (for example, a pH adjuster (52) of the embodiment), wherein the recovery device includes an absorption part (for example, an absorption part (12) of the embodiment) in which an anode side electrolytic solution composed of a strong alkaline aqueous solution and carbon dioxide gas are brought into contact with each other so that the carbon dioxide is dissolved and absorbed in the anode side electrolytic solution, and a concentration part (for example, a concentration part (11, 13) of the embodiment) that concentrates carbon dioxide, the electrochemical reaction device includes an anode (for example, an anode (22) of the embodiment), a cathode (for example, a cathode (21) of the embodiment), an anion exchange membrane (for example, an anion exchange membrane (23) of the embodiment) provided between the anode and the cathode, a liquid flow path (for example, a liquid flow path (29*a*) of the embodiment) provided between the anode and the anion exchange membrane and through which the anode side electrolytic solution that has absorbed the carbon dioxide in the absorption part flows, and a liquid flow path (for example, a liquid flow path (28*a*) of the embodiment) provided between the cathode and the anion exchange membrane and through which a cathode side electrolytic solution composed of a strong alkaline aqueous solution of which a pH has been adjusted by the pH adjuster flows, the pH of the cathode side electrolytic solution being higher than that of the anode side electrolytic solution, and the carbon dioxide gas is supplied from the concentration part to a gas flow path (for example, a gas flow path (24*a*) of the embodiment) on a side of the cathode opposite to the anode, and the carbon dioxide gas is reduced at the cathode.

(2) The carbon dioxide treatment apparatus according to the aspect of the present invention may further include a power storage device (for example, a power storage device (3) of the embodiment) configured to supply electric power to the electrochemical reaction device, and the power storage device may include a conversion part (for example, a conversion part (31) of the embodiment) that converts renewable energy into electrical energy, and a storage part (for example, a storage part (32) of the embodiment) that stores the electrical energy converted by the conversion part.

(3) The storage part may be a nickel metal hydride battery, the nickel metal hydride battery may include a positive electrode (for example, a positive electrode (33) of the embodiment), a negative electrode (for example, a negative electrode (34) of the embodiment), a separator (for example, a separator (37) of the embodiment) provided between the positive electrode and the negative electrode, a positive electrode side flow path (for example, a positive electrode side flow path (36) of the embodiment) provided between the positive electrode and the separator, and a negative electrode side flow path (for example, a negative electrode side flow path (35) of the embodiment) provided between the negative electrode and the separator, when the nickel metal hydride battery is discharged, the anode side electrolytic solution may be circulated in an order of the absorption part, the negative electrode side flow path, the electrochemical reaction device, and the absorption part, and when the nickel metal hydride battery is charged, the anode side electrolytic solution may be circulated in an order of the absorption part, the negative electrode side flow path, the electrochemical reaction device, the positive electrode side flow path, and the absorption part.

(4) The pH adjuster may bring the cathode side electrolytic solution into contact with the carbon dioxide gas.

(5) The carbon dioxide treatment apparatus according to the aspect of the present invention may further include a carbon increase reaction device (for example, a carbon increase reaction device (4) of the embodiment) that increases an amount of ethylene generated by reducing carbon dioxide in the electrochemical reaction device and increases the number of carbon atoms.

(6) The carbon dioxide treatment apparatus according to the aspect of the present invention may further include a heat exchanger (for example, a heat exchanger (43) of the embodiment) that heats the anode side electrolytic solution by exchanging heat between a heat medium heated by heat due to a reaction in the carbon increase reaction device and the anode side electrolytic solution.

(7) A carbon dioxide treatment method according to an aspect of the present invention includes bringing carbon dioxide gas into contact with an anode side electrolytic solution composed of a strong alkaline aqueous solution so that the carbon dioxide is dissolved and absorbed in the anode side electrolytic solution, adjusting a pH of a cathode side electrolytic solution to be higher than that of the anode side electrolytic solution, and supplying the cathode side electrolytic solution between a cathode and an anion exchange membrane, supplying the anode side electrolytic solution between an anode and the anion exchange membrane, supplying carbon dioxide gas to a side of the cathode opposite to the anode, and electrochemically reducing the carbon dioxide gas to generate a carbon compound and hydrogen.

(8) In adjusting the pH of the cathode side electrolytic solution, the cathode side electrolytic solution may be brought into contact with carbon dioxide, and the carbon dioxide may be dissolved in the cathode side electrolytic solution.

(9) A method for producing a carbon compound, wherein the carbon compound in which carbon dioxide is reduced is produced using the carbon dioxide treatment method according to the aspect of (7) or (8).

(10) The method for producing a carbon compound according to the aspect of the present invention may further include increasing an amount of ethylene generated by reducing the carbon dioxide.

According to the aspects of (1) to (10), it is possible to provide a carbon dioxide treatment apparatus, a carbon dioxide treatment method, and a method for producing a carbon compound that have high energy efficiency in recovery and reduction of carbon dioxide and are highly effective in reducing loss of carbon dioxide.

DETAILED DESCRIPTION OF THE INVENTION

Figure 1:
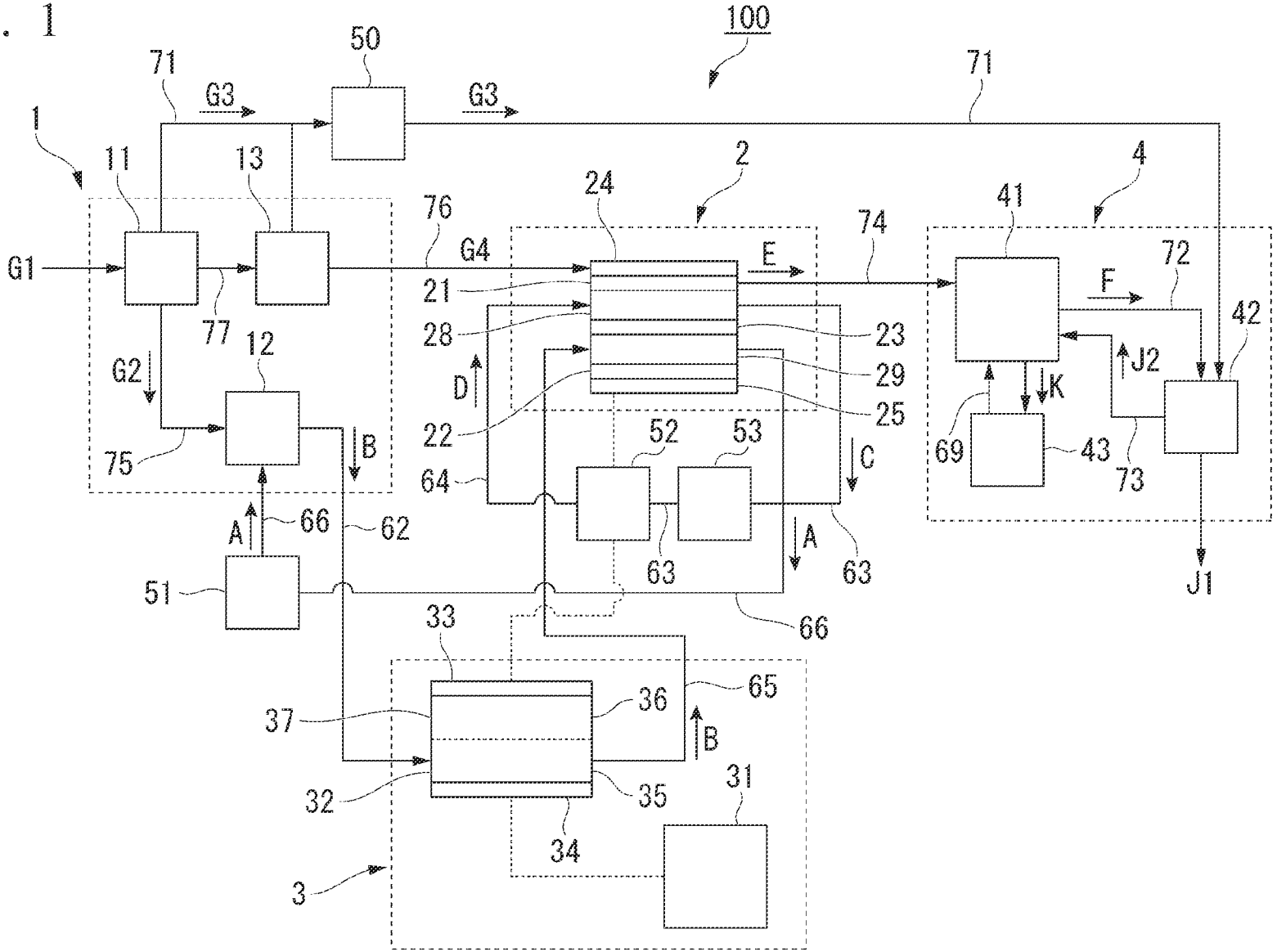
FIG. 1 is a block diagram showing a carbon dioxide treatment apparatus according to an embodiment.

Hereinafter, an embodiment of the present invention will be described with reference to the drawings. The dimensions and the like in the drawings exemplified in the following description are examples, and the present invention is not necessarily limited thereto, and the present invention can be appropriately modified without changing the gist thereof.

[Carbon Dioxide Treatment Apparatus]

As shown in FIG. 1, a carbon dioxide treatment apparatus 100 according to one aspect of the present invention includes a recovery device 1, an electrochemical reaction device 2, a power storage device 3, a carbon increase reaction device 4, a heat exchanger 43, and a pH adjuster 52. The recovery device 1 includes a concentration part 11, an absorption part 12, and a concentration part 13. The power storage device 3 includes a conversion part 31 and a storage part 32 electrically connected to the conversion part 31. The carbon increase reaction device 4 includes a reactor 41 and a gas-liquid separator 42.

In the carbon dioxide treatment apparatus 100, the concentration part 11 and the absorption part 12 are connected by a gas flow path 75. The concentration part 11 and the concentration part 13 are connected by a gas flow path 77. The absorption part 12 and the storage part 32 are connected by a liquid flow path 62. The electrochemical reaction device 2 and the storage part 32 are connected by a liquid flow path 65. The electrochemical reaction device 2 and the absorption part 12 are connected by a liquid flow path 66. The electrochemical reaction device 2 and the reactor 41 are connected by a gas flow path 74. The reactor 41 and the gas-liquid separator 42 are connected by a gas flow path 72 and a gas flow path 73. A circulation flow path 69 of a heat medium is provided between the reactor 41 and the heat exchanger 43. The concentration part 11 and the concentration part 13 and the gas-liquid separator 42 are connected by a gas flow path 71. The concentration part 13 and the electrochemical reaction device 2 are connected by a gas flow path 76. The pH adjuster 52 and the electrochemical reaction device 2 are connected by a liquid flow path 63 and a liquid flow path 64.

Each of the flow paths is not particularly limited, and known piping or the like can be appropriately used. Air supply means such as a compressor, a pressure reducing valve, a measuring device such as a pressure gauge, and the like can be appropriately installed in the gas flow paths 71 to 77. In FIG. 1, a cooler 50 is installed in the gas flow path 71. Further, liquid supply means such as a pump, a measuring device such as a flow meter, and the like can be appropriately installed in the liquid flow paths 62 to 66. In FIG. 1, a pH measuring device 51 is installed in the liquid flow path 66, and a pH measuring device 53 is installed in the liquid flow path 63.

The recovery device 1 is a device that recovers carbon dioxide.

A gas G1 containing carbon dioxide such as the atmosphere and exhaust gas is supplied to the concentration part 11 and the concentration part 13. In the concentration part 11 and the concentration part 13, carbon dioxide of the gas G1 is concentrated. As the concentration part 11 and the concentration part 13, a known concentrating device can be adopted as long as it can concentrate carbon dioxide, and for example, a membrane separation device that utilizes a difference in a permeation rate with respect to the membrane, or an adsorption separation device that utilizes chemical or physical adsorption and desorption can be used. Among them, adsorption using chemical adsorption, particularly temperature swing adsorption, is preferable from the viewpoint of excellent separation performance.

A concentrated gas G2 in which carbon dioxide is concentrated in the concentration part 11 is sent to the absorption part 12 through the gas flow path 75. Further, a separated gas G3 separated from the concentrated gas G2 is sent to the gas-liquid separator 42 through the gas flow path 71.

A concentrated gas G4 in which carbon dioxide is concentrated in the concentration part 13 is sent to the electrochemical reaction device 2 through the gas flow path 75. Further, a separated gas separated from the concentrated gas G4 is sent to the gas-liquid separator 42 through the gas flow path 71 together with the separated gas G3.

In the absorption part 12, a carbon dioxide gas in the concentrated gas G2 supplied from the concentration part 11 comes into contact with an anode side electrolytic solution A, and carbon dioxide is dissolved and absorbed in the anode side electrolytic solution A. A method of bringing the carbon dioxide gas into contact with the anode side electrolytic solution A is not particularly limited, and for example, a method in which the concentrated gas G2 is blown into the anode side electrolytic solution A and bubbling the solution is performed can be exemplified.

In the absorption part 12, the anode side electrolytic solution A made of a strong alkaline aqueous solution is used as an absorption solution for absorbing carbon dioxide. In the carbon dioxide, a carbon atom is positively charged (6+) because oxygen atoms strongly attract electrons. Therefore, in a strong alkaline aqueous solution in which a large amount of hydroxide ions are present, a dissolution reaction of carbon dioxide easily proceeds from a hydrated state to $CO_3^{2-}$ via $HCO^{3-}$, and an equilibrium state in which an abundance ratio of $CO_3^{2-}$ is high is reached. For this reason, carbon dioxide is more easily dissolved in a strong alkaline aqueous solution than other gases such as nitrogen, hydrogen, and oxygen, and in the absorption part 12, the carbon dioxide in the concentrated gas G2 is selectively absorbed in the anode side electrolytic solution A. In this way, the concentration of carbon dioxide can be assisted using the anode side electrolytic solution A in the absorption part 12. Therefore, it is not necessary to concentrate carbon dioxide to a high concentration in the concentration part 11, and energy required for the concentration in the concentration part 11 can be reduced.

An anode side electrolytic solution B in which carbon dioxide is absorbed in the absorption part 12 is sent to the electrochemical reaction device 2 through the liquid flow path 62, the storage part 32, and the liquid flow path 65. Further, the anode side electrolytic solution A flowing out of the electrochemical reaction device 2 is sent to the absorption part 12 through the liquid flow path 66. In this way, in the carbon dioxide treatment apparatus 100, the anode side electrolytic solution is circulated and shared between the absorption part 12, the storage part 32, and the electrochemical reaction device 2.

Examples of the strong alkaline aqueous solution used for the anode side electrolytic solution A include a potassium hydroxide aqueous solution and a sodium hydroxide aqueous solution. Among them, the potassium hydroxide aqueous solution is preferable, because it has excellent solubility of carbon dioxide in the absorption part 12 and the reduction of carbon dioxide in the electrochemical reaction device 2 is promoted.

Figure 2:
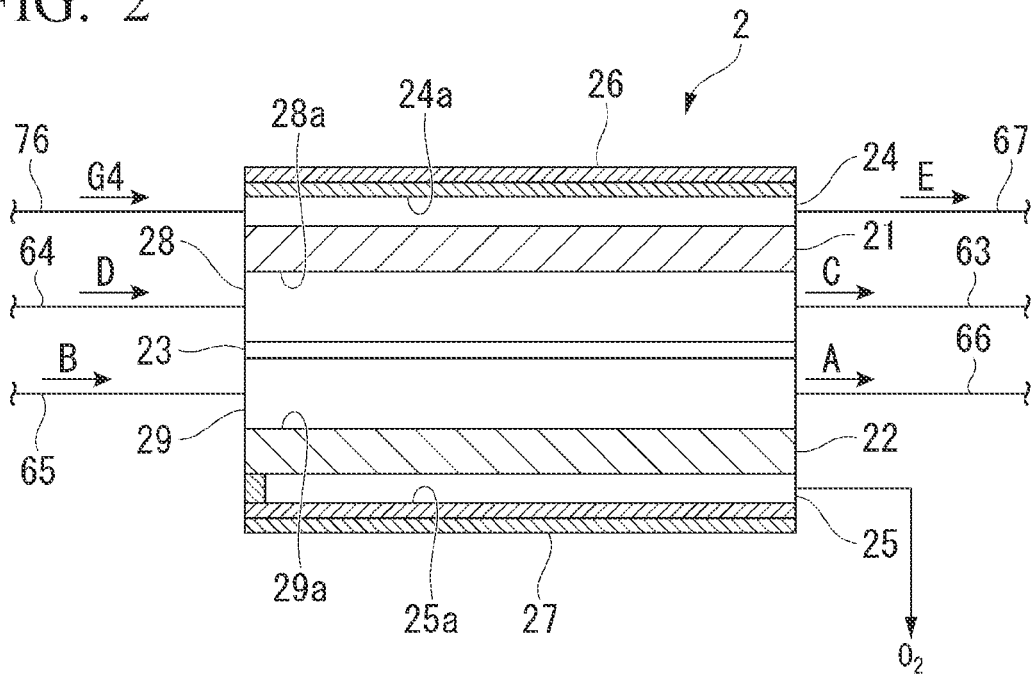
FIG. 2 is a schematic cross-sectional view showing an example of an electrolytic cell of an electrochemical reaction device.

The electrochemical reaction device 2 is a device that electrochemically reduces carbon dioxide. As shown in FIG. 2, the electrochemical reaction device 2 includes a cathode 21, an anode 22, an anion exchange membrane 23, a liquid flow path structure 28 for forming a liquid flow path 28*a*, a liquid flow path structure 29 for forming a liquid flow path 29*a*, a gas flow path structure 24 in which the gas flow path 24*a* is formed, a gas flow path structure 25 in which a gas flow path 25*a* is formed, a power supply body 26, and a power supply body 27.

In the electrochemical reaction device 2, the power supply body 26, the gas flow path structure 24, the cathode 21, the liquid flow path structure 28, the anion exchange membrane 23, the liquid flow path structure 29, the anode 22, the gas flow path structure 25, and the power supply body 27 are laminated in this order. A slit is formed in the liquid flow path structures 28 and 29, and regions surrounded by the cathode 21, the anode 22, and the liquid flow path structures 28 and 29 in the slit become the liquid flow paths 28*a* and 29*a*, respectively. A groove is formed on the cathode 21 side of the gas flow path structure 24, and a portion of the groove surrounded by the gas flow path structure 24 and the cathode 21 becomes the gas flow path 24*a*. A groove is formed on the anode 22 side of the gas flow path structure 25, and a portion of the groove surrounded by the gas flow path structure 25 and the anode 22 becomes the gas flow path 25*a*.

As described above, in the electrochemical reaction device 2, the liquid flow path 28*a* is formed between the cathode 21 and the anion exchange membrane 23, the liquid flow path 29*a* is formed between the anode 22 and the anion exchange membrane 23, the gas flow path 24*a* is formed between the cathode 21 and the power supply body 26, and the gas flow path 25*a* is formed between the anode 22 and the power supply body 27. The power supply body 26 and the power supply body 27 are electrically connected to the storage part 32 of the power storage device 3. Further, the gas flow path structure 24 and the gas flow path structure 25 are conductors, and a voltage can be applied between the cathode 21 and the anode 22 by electric power supplied from the storage part 32.

The cathode 21 is an electrode that reduces carbon dioxide to produce a carbon compound and reduces water to produce hydrogen. The cathode 21 may be any one as long as it can electrochemically reduce carbon dioxide and the generated gaseous carbon compound and hydrogen permeate to the gas flow path 24*a*, and for example, an electrode in which a cathode catalyst layer is formed on the liquid flow path 23*a* side of a gas diffusion layer can be exemplified. A part of the cathode catalyst layer may enter the gas diffusion layer. A porous layer that is denser than the gas diffusion layer may be disposed between the gas diffusion layer and the cathode catalyst layer.

As a cathode catalyst that forms the cathode catalyst layer, a known catalyst that promotes the reduction of carbon dioxide can be used. Specific examples of the cathode catalyst include metals such as gold, silver, copper, platinum, palladium, nickel, cobalt, iron, manganese, titanium, cadmium, zinc, indium, gallium, lead, and tin, alloys thereof, intermetallic compounds thereof, and metal complexes such as ruthenium complexes and rhenium complexes. Among them, copper and silver are preferable because the reduction of carbon dioxide is promoted, and copper is more preferable. As the cathode catalyst, one type may be used alone, or two or more types may be used in combination.

As the cathode catalyst, a supported catalyst in which metal particles are supported on a carbon material (carbon particles, carbon nanotubes, graphene, or the like) may be used.

The gas diffusion layer of the cathode 21 is not particularly limited, and examples thereof include carbon paper and carbon cloth.

A method for manufacturing the cathode 21 is not particularly limited, and for example, a method in which a liquid composition containing a cathode catalyst is applied to a surface of the gas diffusion layer on the liquid flow path 23*a* side and is then dried can be exemplified.

The anode 22 is an electrode that oxidizes hydroxide ions to generate oxygen. The anode 22 may be any one as long as it can electrochemically oxidize hydroxide ions and the generated oxygen permeates to the gas flow path 25*a*, and for example, an electrode in which an anode catalyst layer is formed on the liquid flow path 23*a* side of the gas diffusion layer can be exemplified.

An anode catalyst that forms the anode catalyst layer is not particularly limited, and a known anode catalyst can be used. Specifically, examples thereof include metals such as platinum, palladium, and nickel, alloys thereof, intermetallic compounds thereof, metal oxides such as manganese oxide, iridium oxide, nickel oxide, cobalt oxide, iron oxide, tin oxide, indium oxide, ruthenium oxide, lithium oxide and lanthanum oxide, and metal complexes such as ruthenium complex and rhenium complex. As the anode catalyst, one type may be used alone, or two or more types may be used in combination.

Examples of the gas diffusion layer of the anode 22 include carbon paper and carbon cloth. Further, as the gas diffusion layer, a porous body such as a mesh material, a punching material, a porous material, and a metal fiber sintered body may be used. Examples of a material of the porous body include metals such as titanium, nickel, and iron, and alloys thereof (for example, SUS).

As a material of the liquid flow path structures 28 and 29, for example, a fluororesin such as polytetrafluoroethylene can be exemplified.

Examples of a material of the gas flow path structures 24 and 25 include metals such as titanium and SUS, and carbon.

Examples of a material of the power supply bodies 26 and 27 include metals such as copper, gold, titanium, and SUS, and carbon. As the power supply bodies 26 and 27, those having a surface of a copper base material plated with gold or the like may be used.

The anion exchange membrane 23 is not particularly limited, and a conventionally known anion exchange membrane can be used.

Figure 3:
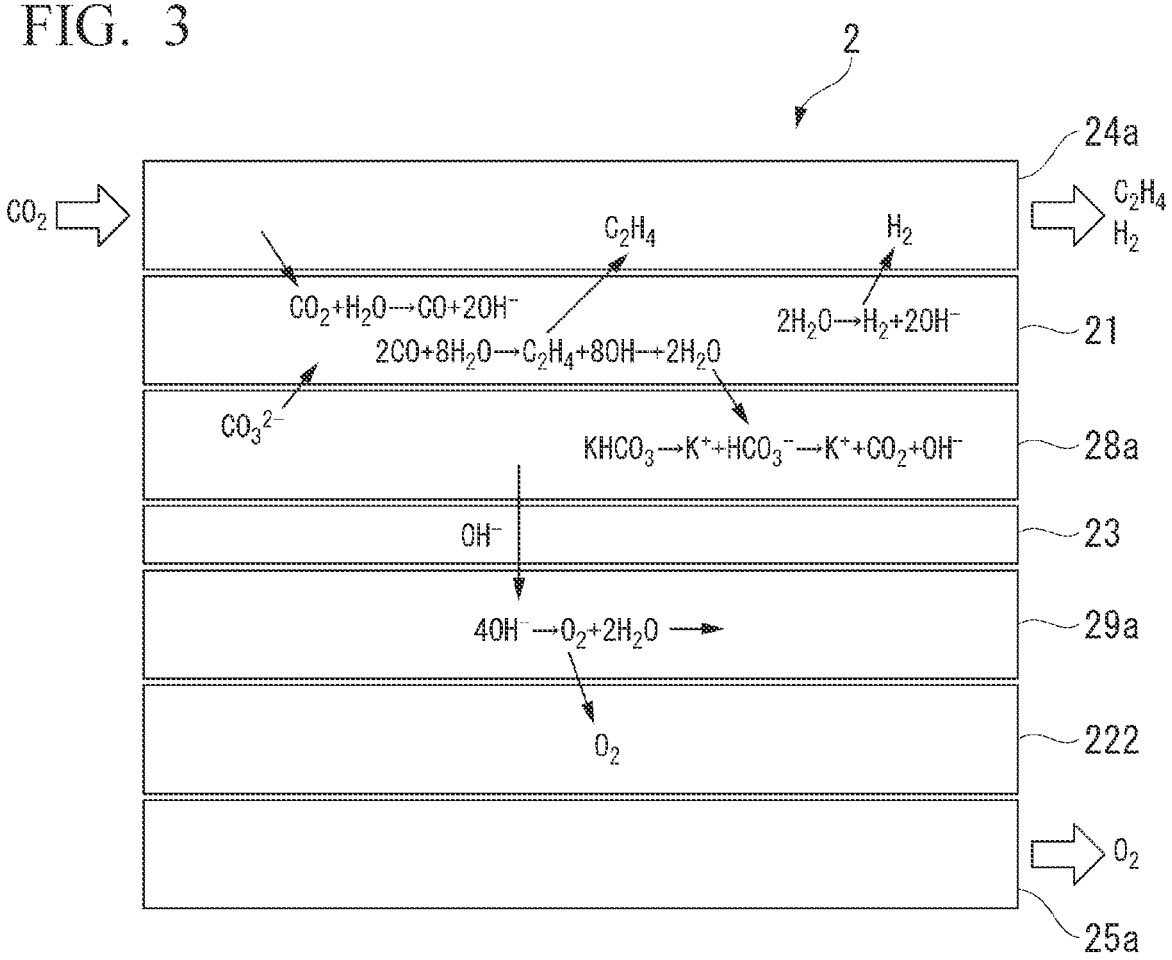
FIG. 3 is a schematic diagram showing an electrochemical reaction that occurs in the electrolytic cell.

The electrochemical reaction device 2 is a flow cell in which the anode side electrolytic solution B supplied from the absorption part 12 flows through the liquid flow path 29*a*, a cathode side electrolytic solution D supplied from the pH adjuster 52 flows through the liquid flow path 28*a*, and the concentrated gas G4 supplied from the concentration part 13 flows through the gas flow path 24*a*. Then, when a voltage is applied to the cathode 21 and the anode 22, carbon dioxide in the concentrated gas G4 flowing through the gas flow path 24*a* is reduced, and a carbon compound and hydrogen are generated. FIG. 3 shows an electrochemical reaction in an electrochemical cell of the electrochemical reaction device 2. Since $CO_3^{2-}$ is consumed at the cathode, a pH of the cathode side electrolytic solution is higher on the outlet side than on the inlet side of the liquid flow path 28*a*. The anode consumes hydroxide ions, but since an equal amount of hydroxide ions are supplied from the cathode side, the pH of the anode side electrolytic solution does not change between the inlet side and the outlet side of the liquid flow path 29*a*. The pH adjuster 52 adjusts the pH of the cathode side electrolytic solution C to generate the cathode side electrolytic solution D, but in the adjustment of the pH, an alkali such as KOH or an alkaline aqueous solution can be used to raise the pH, or carbon dioxide gas can be used to lower the pH. As the carbon dioxide supplied to the pH adjuster 52, for example, carbon dioxide in the concentrated gas generated by the concentration part 11 or the concentration part 13 can be used.

Examples of the carbon compound generated by reducing carbon dioxide at the cathode 21 include carbon monoxide, ethylene, ethanol, and the like. For example, as shown in FIG. 3, carbon monoxide and ethylene are generated as gaseous products by the following reaction. Hydrogen is also generated at the cathode 21 by the following reaction. The generated gaseous carbon compound and hydrogen pass through the gas diffusion layer of the cathode 21 and flow out of the gas flow path 24*a*.

$$CO_2+H_2O \rightarrow CO+2OH^-$$

$$2CO+8H_2O \rightarrow C_2H_4+8OH^-+2H_2O$$

$$2H_2O \rightarrow H_2+2OH^-$$

Further, the hydroxide ions generated at the cathode 21 move to the anode 22 in the anode side electrolytic solution B and are oxidized by the following reaction to generate oxygen. The generated oxygen passes through the gas diffusion layer of the anode 22 and is discharged from the gas flow path 25*a*.

$$4OH^- \rightarrow H_2+2H_2O$$

At the cathode 21, $H_2$ generation due to water electrolysis which is a side reaction that does not involve the desired $CO_2$ reduction reaction contributes to energy loss in $CO_2$ electrolysis.

In order to suppress the generation of $H_2$ at the cathode in the embodiment, a balance in catalytic activity of the anode and the cathode is very important. For example, when the anode has high activity and the cathode has low activity, $O_2$generation at the anode must occur actively, and a reaction with the same number of electrons must also occur at the cathode, but when a $CO_2$ electrolysis reaction rate at the cathode is not sufficiently obtained, a water electrolysis $H_2$ generation reaction which is a side reaction occurs. And, in that event, a solution of an optimum reaction rate management changes according to the level and balance of deterioration of the catalyst in each of two electrodes during an operation of the carbon dioxide treatment apparatus. Therefore, it is useful when there is a means for flexibly managing the reaction rate at both electrodes. In the embodiment, the pH of the electrolytic solution is used as the means for flexibly managing the reaction rate. More specifically, the pH of the anode side electrolytic solution is made lower than the pH of the cathode side electrolytic solution. Examples of a means for adjusting the pH of the electrolytic solution include a means for adding an alkali such as KOH or an alkaline aqueous solution such as a KOH aqueous solution to the electrolytic solution (pH increase), a means for dissolving carbon dioxide in the electrolytic solution which is an alkaline aqueous solution (pH decrease), and the like. Normally, since the pH is lowered by blowing carbon dioxide and dissolving the carbon dioxide in an electrolytic solution which is a strong alkaline aqueous solution, the pH can be adjusted by controlling an amount of carbon dioxide dissolved in the electrolytic solution which is a strong alkaline aqueous solution. Further, a product thereof is usually a gas, and a generation rate of the target carbon compound and by-product $H_2$ can be quantified by sensing a gas flow rate, a $H_2$ concentration, and a target product concentration at the outlet of the carbon dioxide treatment apparatus 100. From the quantification results, an optimum reaction rate at that time can be obtained under any catalyst deterioration condition by feeding-back [an amount of $CO_2$ dissolved in cathode side electrolytic solution] and [an amount of $CO_2$ dissolved in the anode side electrolytic solution] with [maximization of the generation rate of the target product] and [minimization of the generation rate of the by-product $H_2$] as objective variables.

Specific examples of the pH include the pH of the anode side electrolytic solution set to 14 or less, for example, in a range of 8 to 14, and the pH of the cathode side electrolytic solution set to more than 14.

In the carbon dioxide treatment apparatus 100, the hydrogen generation at the cathode 21 is suppressed by making the pH of the cathode side electrolytic solution used in the electrochemical reaction device 2 higher than the pH of the anode side electrolytic solution. Thus, for example, as compared with a case in which carbon dioxide is adsorbed on an adsorbent and desorbed by heating to be reduced, the energy required for desorption of carbon dioxide can be reduced, energy efficiency can be increased, and the loss of carbon dioxide can also be reduced.

The power storage device 3 is a device that supplies electric power to the electrochemical reaction device 2.

In the conversion part 31, renewable energy is converted into electrical energy. The conversion part 31 is not particularly limited, and examples thereof include a wind power generator, a solar power generator, and a geothermal power generator. The number of conversion parts 31 included in the power storage device 3 may be one, or two or more.

In the storage part 32, electrical energy converted by the conversion part 31 is stored. Electric power can be stably supplied to the electrochemical reaction device 2 even during a time period when the conversion part does not generate power by storing the converted electrical energy in the storage part 32. Further, when renewable energy is used, voltage fluctuations tend to be large in general, but once the renewable energy is stored in the storage part 32, electric power can be supplied to the electrochemical reaction device 2 at a stable voltage.

The storage part 32 in this example is a nickel metal hydride battery. The storage part 32 may be any one as long as it can be charged and discharged, and may be, for example, a lithium ion secondary battery or the like.

Figure 4:
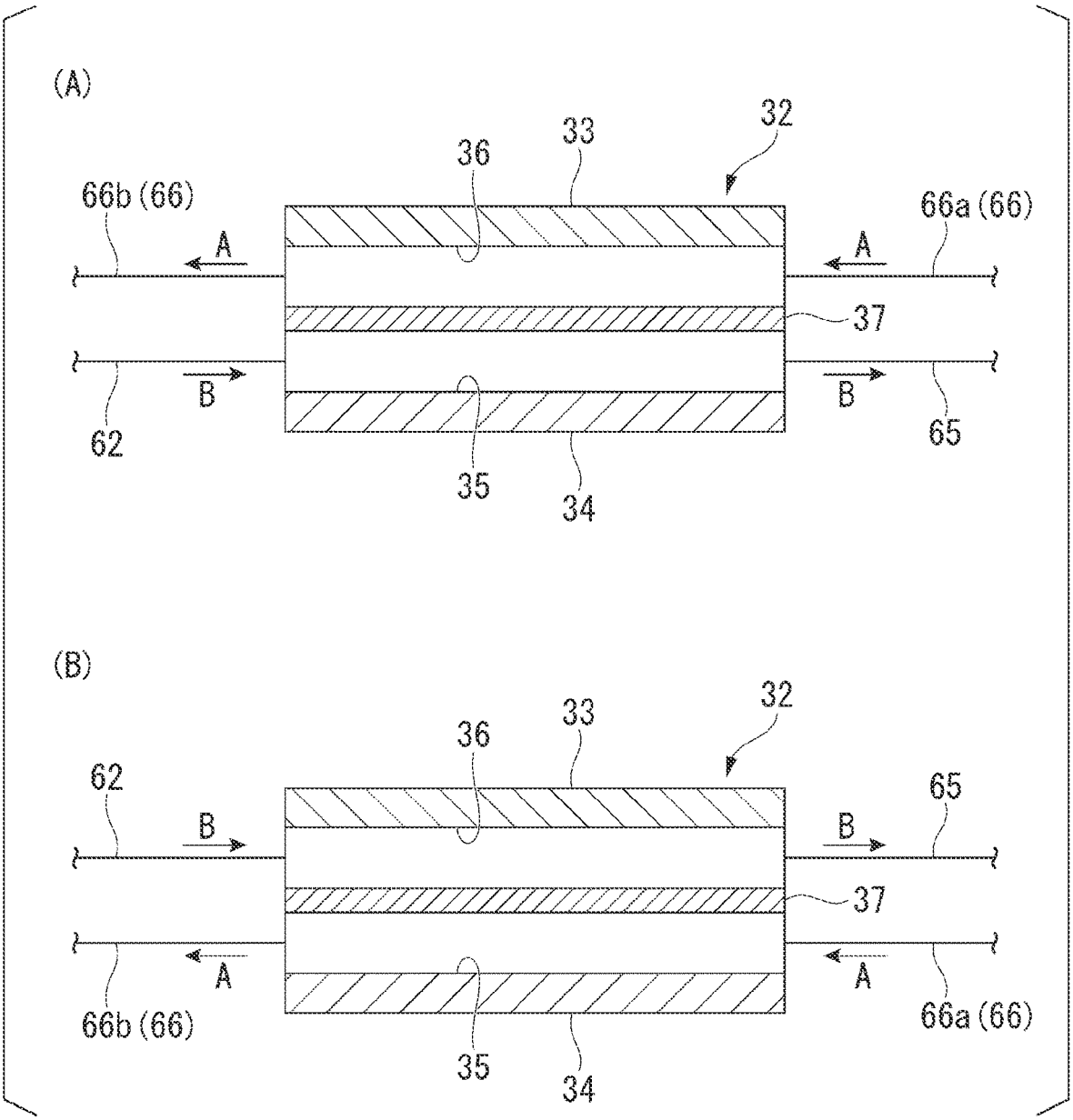
FIG. 4 is a schematic cross-sectional view showing a nickel metal hydride battery as an example of a storage part.

As shown in FIG. 4A, the storage part 32 is a nickel metal hydride battery including a positive electrode 33, a negative electrode 34, a separator 37 provided between the positive electrode 33 and the negative electrode 34, a positive electrode side flow path 36 formed between the positive electrode 33 and the separator 37, and a negative electrode side flow path 35 formed between the negative electrode 34 and the separator 37. The positive electrode side flow path 36 and the negative electrode side flow path 35 can be formed using, for example, the same liquid flow path structure as that of the liquid flow path 28*a* (29*a*) of the electrochemical reaction device 2.

As the positive electrode 33, for example, one in which a positive electrode active material is applied on the positive electrode side flow path 36 side of a positive electrode current collector can be exemplified.

The positive electrode current collector is not particularly limited, and examples thereof can include a nickel foil and a nickel-plated metal foil.

The positive electrode active material is not particularly limited, and examples thereof can include nickel hydroxide and nickel oxyhydroxide.

As the negative electrode 34, for example, a negative electrode active material applied on the negative electrode side flow path 35 side of a negative electrode current collector can be exemplified.

The negative electrode current collector is not particularly limited, and examples thereof can include nickel meshes.

The negative electrode active material is not particularly limited, and examples thereof can include known hydrogen storage alloys.

The separator 37 is not particularly limited, and examples thereof can include ion exchange membranes.

The nickel metal hydride battery of the storage part 32 is a flow cell in which the electrolytic solution flows in each of the positive electrode side flow path 36 on the positive electrode 33 side of the separator 37 and the negative electrode side flow path 35 on the negative electrode side 34 side of the separator 37. In the carbon dioxide treatment apparatus 100, the anode side electrolytic solution B supplied from the absorption part 12 through the liquid flow path 62, and the anode side electrolytic solution A supplied from the electrochemical reaction device 2 through the liquid flow path 66*a* flow through the negative electrode side flow path 35 and the positive electrode side flow path 36, respectively. Further, the connection of the liquid flow paths 62 and 65 to the storage part 32 can be switched between a state in which each of the liquid flow paths 62 and 65 is connected to the negative electrode side flow path 35 and a state in which each of the liquid flow paths 62 and 65 is connected to the positive electrode side flow path 36. Similarly, the connection of the liquid flow paths 66*a* and 66*b* to the storage part 32 can be switched between a state in which each of the liquid flow paths 66*a* and 66*b* is connected to the positive electrode side flow path 36 and a state in which each of the liquid flow paths 66*a* and 66*b* is connected to the negative electrode side flow path 35.

When the nickel metal hydrogen battery is discharged, hydroxide ions are generated from water molecules at the positive electrode, and the hydroxide ions transferred to the negative electrode receive hydrogen ions from the hydrogen storage alloy to generate water molecules. Therefore, from the viewpoint of discharge efficiency, it is advantageous that the electrolytic solution flowing through the positive electrode side flow path 36 is in a strong alkaline state, and it is advantageous that the electrolytic solution flowing through the negative electrode side flow path 35 is in a weak alkaline state. Therefore, at the time of discharge, as shown in FIG. 4A, it is preferable that the liquid flow paths 62 and 65 be connected to the negative electrode side flow path 35, the liquid flow paths 66*a* and 66*b* be connected to the positive electrode side flow path 36, the anode side electrolytic solution B (weak alkali) supplied from the absorption part 12 flow through the negative electrode side flow path 35, and the anode side electrolytic solution A (strong alkali) supplied from the electrochemical reaction device 2 flows through the positive electrode side flow path 36. That is, at the time of discharge, it is preferable that the electrolytic solution be circulated in the order of the absorption part 12, the negative electrode side flow path 35 of the storage part 32, the electrochemical reaction device 2, the positive electrode side flow path 36 of the storage part 32, and the absorption part 12.

Further, when the nickel metal hydrogen battery is charged, water molecules are generated from hydroxide ions at the positive electrode, water molecules are decomposed into hydrogen atoms and hydroxide ions at the negative electrode, and the hydrogen atoms are stored in the hydrogen storage alloy. Therefore, from the viewpoint of charging efficiency, it is advantageous that the electrolytic solution flowing through the positive electrode side flow path 36 is in a weak alkaline state, and it is advantageous that the electrolytic solution flowing through the negative electrode side flow path 35 is in a strong alkaline state. Therefore, at the time of charging, as shown in FIG. 4B, it is preferable that the liquid flow paths 62 and 65 be connected to the positive electrode side flow path 36, the liquid flow paths 66*a* and 66*b* be connected to the negative electrode side flow path 35, the anode side electrolytic solution B (weak alkali) supplied from the absorption part 12 flows through the positive electrode side flow path 36, and the anode side electrolytic solution A (strong alkali) supplied from the electrochemical reaction device 2 flow through the negative electrode side flow path 35. That is, at the time of charging, it is preferable that the electrolytic solution be circulated in the order of the absorption part 12, the positive electrode side flow path 36 of the storage part 32, the electrochemical reaction device 2, the negative electrode side flow path 35 of the storage part 32, and the absorption part 12.

In general, when a secondary battery is incorporated into the apparatus, the overall energy efficiency tends to decrease by an amount of charge and discharge efficiency. However, as described above, the charge and discharge efficiency according to an amount of "concentration overvoltage" of an electrode reaction represented by the Nernst equation can be improved by appropriately replacing the electrolytic solutions flowing through the positive electrode side flow path 36 and the negative electrode side flow path 35 of the storage part 32 using pH gradients of the anode side electrolytic solution A and the anode side electrolytic solution B before and after the electrochemical reaction device 2.

The carbon increase reaction device 4 is a device for increasing an amount of ethylene generated by reducing carbon dioxide in the electrochemical reaction device 2 to increase the number of carbon atoms.

Ethylene gas E generated by the reduction at the cathode 21 of the electrochemical reaction device 2 is sent to the reactor 41 through the gas flow path 74. In the reactor 41, an ethylene multimerization reaction is carried out in the presence of an olefin multimerization catalyst. Thus, for example, olefins, in which the number of carbon atoms is increased, such as 1-butene, 1-hexene, and 1-octene can be produced.

The olefin multimerization catalyst is not particularly limited, and a known catalyst used for a multimerization reaction can be used, and examples thereof can include a solid acid catalyst using silica alumina or zeolite as a carrier and a transition metal complex compound.

In the carbon increase reaction device 4 of this example, a generated gas F after the multimerization reaction flowing out of the reactor 41 is sent to the gas-liquid separator 42 through the gas flow path 72. An olefin having 6 or more carbon atoms is a liquid at room temperature. Therefore, for example, when the olefin having 6 or more carbon atoms is set as the target carbon compound, the olefin having 6 or more carbon atoms (an olefin liquid J1) and the olefin having less than 6 carbon atoms (an olefin gas J2) can be easily separated into gas and liquid by setting a temperature of the gas-liquid separator 42 to about 30° C. Further, the number of carbon atoms in the obtained olefin liquid J1 can be considerably increased by raising the temperature of the gas-liquid separator 42.

When the gas G1 supplied to the concentration part 11 of the recovery device 1 is the atmosphere, the separated gas G3 sent from the concentration part 11 through the gas flow path 71 may be used for cooling a generated gas D in the gas-liquid separator 42. For example, using the gas-liquid separator 42 equipped with a cooling pipe, the separated gas G3 is passed through the cooling pipe, a generated gas F is passed outside the cooling pipe and is aggregated on a surface of the cooling pipe to obtain the olefin liquid J1. Further, since the olefin gas J2 separated in the gas-liquid separator 42 contains unreacted components such as ethylene and an olefin having a smaller number of carbon atoms than that in the target olefin, the olefin gas J2 can be returned to the reactor 41 through the gas flow path 73 and reused for the multimerization reaction.

The ethylene multimerization reaction in the reactor 41 is an exothermic reaction in which a supplied substance has a higher enthalpy than a generated substance and reaction enthalpy is negative. In the carbon dioxide treatment apparatus 100, a heat medium K may be heated using reaction heat generated in the reactor 41 of the carbon increase reaction device 4, the heat medium K may be circulated to the heat exchanger 43 through the circulation flow path 69, and heat may be exchanged between the heat medium K and the anode side electrolytic solution B in the heat exchanger 43. In this case, the anode side electrolytic solution B supplied to the electrochemical reaction device 2 is heated. In the anode side electrolytic solution B using a strong alkaline aqueous solution, since dissolved carbon dioxide is less likely to separate as a gas even when the temperature is raised, and a temperature of the anode side electrolytic solution B rises, a reaction rate of oxidation and reduction in the electrochemical reaction device 2 improves.

The carbon increase reaction device 4 may further include a reactor in which a hydrogenation reaction of an olefin obtained by increasing the amount of ethylene is performed, or a reactor in which an isomerization reaction of an olefin or paraffin is performed using the hydrogen generated in the electrochemical reaction device 2.

[Carbon Dioxide Treatment Method]

A carbon dioxide treatment method according to one aspect of the present invention is a method including the following Steps (a) and (b). The carbon dioxide treatment method of the present invention can be used in a method for producing a carbon compound. That is, a carbon compound obtained by reducing carbon dioxide or a carbon compound obtained using a carbon compound obtained by reducing carbon dioxide as a raw material can be produced using the carbon dioxide treatment method of the present invention.

Step (a): The carbon dioxide gas is brought into contact with the anode side electrolytic solution composed of a strong alkaline aqueous solution, and carbon dioxide is dissolved and absorbed in the anode side electrolytic solution.

Step (b): The pH of the cathode side electrolytic solution is adjusted to be higher than the pH of the anode side electrolytic solution.

Step (c): The cathode side electrolytic solution is supplied between the cathode and the anion exchange membrane, the anode side electrolytic solution is supplied between the anode and the anion exchange membrane, the carbon dioxide gas is supplied to the side of the cathode opposite to the anode, and the carbon dioxide gas is electrochemically reduced to generate a carbon compound and hydrogen.

When a carbon dioxide treatment apparatus including the carbon increase reaction device as in the carbon dioxide treatment apparatus 100 is used, the carbon dioxide treatment method further includes the following Step (d) in addition to Steps (a) to (c). Hereinafter, as an example of the carbon dioxide treatment method, a case in which the above-described carbon dioxide treatment apparatus 100 is used will be described.

Step (d): The amount of ethylene generated by the reduction of carbon dioxide is increased.

In the carbon dioxide treatment method using the carbon dioxide treatment apparatus 100, first, exhaust gas, the atmosphere, and the like are supplied to the concentration part 11 as the gas G1, and the carbon dioxide is concentrated to obtain the concentrated gas G2. As described above, since the absorption of carbon dioxide by the anode side electrolytic solution A in the absorption part 12 assists the concentration, it is not necessary to concentrate carbon dioxide to a high concentration in the concentration part 11. The concentration of carbon dioxide in the concentrated gas G2 can be appropriately set and can be, for example, 25 to 85% by volume.

In Step (a), the concentrated gas G2 is supplied from the concentration part 11 to the absorption part 12, the concentrated gas G2 is brought into contact with the anode side electrolytic solution A, and carbon dioxide in the concentrated gas G2 is dissolved and absorbed in the anode side electrolytic solution A. The anode side electrolytic solution B in which carbon dioxide is dissolved is in the weak alkaline state. Further, the anode side electrolytic solution B may be supplied from the absorption part 12 to the heat exchanger 43 via the storage part 32, and the anode side electrolytic solution B heated by heat exchange with the heat medium K may be supplied to the electrochemical reaction device 2. The temperature of the anode side electrolytic solution B supplied to the electrochemical reaction device 2 can be appropriately set and can be, for example, 65 to 105° C.

In Step (b), the pH of the cathode side electrolytic solution is adjusted to be higher than the pH of the anode side electrolytic solution. The pH of the cathode side electrolytic solution can be adjusted by adding an alkali or an alkaline aqueous solution (pH increase), coming into contact with carbon dioxide (pH decrease), or the like. For example, the pH of the cathode side electrolytic solution may be more than 14, and the pH of the anode side electrolytic solution may be 14 or less, specifically in a range of 8 to 14.

In Step (c), the anode side electrolytic solution B flows through the liquid flow path 29*a* of the electrochemical reaction device 2, the cathode side electrolytic solution D flows through the liquid flow path 28*a*, the concentrated gas G4 generated by the concentration part 13 flows through the gas flow path 24*a*, and power is supplied from the power storage device 3 to the electrochemical reaction device 2 so that a voltage is applied between the cathode 21 and the anode 22. The carbon dioxide gas contained in the concentrated gas G4 is electrochemically reduced to generate a carbon compound, and water is reduced to generate hydrogen. At this time, at the anode 22, the hydroxide ions in the anode side electrolytic solution B are oxidized to generate oxygen. An amount of dissolved carbon dioxide in the anode side electrolytic solution B decreases as the reduction progresses, and the anode side electrolytic solution A in the strong alkaline state flows out of an outlet of the liquid flow path 29*a*. The gaseous carbon compound and hydrogen generated by the reduction of carbon dioxide permeate the gas diffusion layer of the cathode 21, flow out of the electrochemical reaction device 2 through the gas flow path 24*a*, and are sent to the carbon increase reaction device 4.

In Step (d), ethylene gas E generated by the reduction of carbon dioxide is sent to the reactor 41 and is brought into gas phase contact with the olefin multimerization catalyst in the reactor 41 to increase the amount of ethylene. Thus, an olefin in which the amount of ethylene is increased can be obtained. For example, when an olefin having 6 or more carbon atoms is set as the target carbon compound, the generated gas F from the reactor 41 is sent to the gas-liquid separator 42 and is cooled to about 30° C. Then, since the target olefin having 6 or more carbon atoms (for example, 1-hexene) is liquefied, and the olefin having less than 6 carbon atoms remains as a gas, the olefin liquid J1 (the target carbon compound) can be easily separated from the olefin gas J2. The number of carbon atoms in each of the olefin liquid J1 and the olefin gas J2 to be separated into a gas and a liquid can be adjusted according to a temperature in the gas-liquid separation.

The olefin gas J2 after the gas-liquid separation can be returned to the reactor 41 and can be reused for the multimerization reaction. In this way, when the olefin having a smaller number of carbon atoms than that of the target olefin is circulated between the reactor 41 and the gas-liquid separator 42, in the reactor 41, it is preferable to adjust a contact time between a raw material gas (a mixed gas of the ethylene gas E and the olefin gas J2) and the catalyst and to perform the control under a condition in which each molecule causes averagely one multimerization reaction. Thus, since an unintentional increase of the number of carbon atoms in the olefin generated in the reactor 41 is suppressed, the olefin having the desired number of carbon atoms (the olefin liquid J1) can be selectively separated in the gas-liquid separator 42.

According to such a method, valuable resources can be efficiently obtained from a renewable carbon source with high selectivity. Therefore, a large-scale refining facility such as a distillation column required in conventional petrochemistry using a Fisher-Tropsch (FT) synthesis method or a MtG method is not required, and an economic advantage is provided overall.

A reaction temperature of the multimerization reaction is preferably 200 to 350° C.

A reaction time of the multimerization reaction, that is, the contact time between the raw material gas and the olefin multimerization catalyst is preferably 10 to 250 g·min/mol in terms of W/F from the viewpoint of suppressing an excessive multimerization reaction and improving selectivity of the target carbon compound.

An olefin having a smaller number of carbon atoms than that in the target olefin may be circulated between the reactor 41 and the gas-liquid separator 42 to adjust the contact time between the raw material gas and the catalyst, and thus the selectivity of the produced carbon compound may be improved.

Further, the olefin obtained by increasing the amount of ethylene may be hydrogenated to obtain paraffin, or the isomerization may be further performed.

As the hydrogenation reaction of the olefin, a known method can be adopted, and for example, a method in which the hydrogenation reaction is performed using a solid acid catalyst such as silica alumina or zeolite can be exemplified.

As the isomerization reaction, a known method can be adopted, and for example, a method in which the isomerization reaction is performed using a solid acid catalyst such as silica alumina or zeolite can be exemplified.

A reaction temperature in the reactor 84 is preferably 200 to 350° C.

As described above, in an aspect of the present invention, an electrolytic solution composed of a strong alkaline aqueous solution is used, and the electrolytic solution in which carbon dioxide is dissolved is supplied between the cathode and the anode by the recovery device, and the dissolved carbon dioxide in the electrolytic solution is electrochemically reduced. Therefore, the energy efficiency in the carbon dioxide recovery and the reduction is high, and loss of carbon dioxide is also reduced.

The present invention is not limited to the above-described aspect.

Further, the carbon dioxide treatment apparatus of the embodiment may be a carbon dioxide treatment apparatus that includes none of the carbon increase reaction device, the heat exchanger, and the pH adjuster. For example, ethylene may be produced using a carbon dioxide treatment method in which the carbon dioxide treatment apparatus is adopted.

Further, in the carbon dioxide treatment apparatus of the embodiment, the electrochemical reaction device and the power storage device may not share the electrolytic solution, and the electrolytic solution may be circulated only between the absorption part of the recovery device and the electrochemical reaction device.

In addition, it is appropriately possible to replace the constituent elements in the above-described embodiment with well-known constituent elements without departing from the spirit of the present invention, and the above-described modified examples may be appropriately combined.

EXAMPLES

Figure 5:
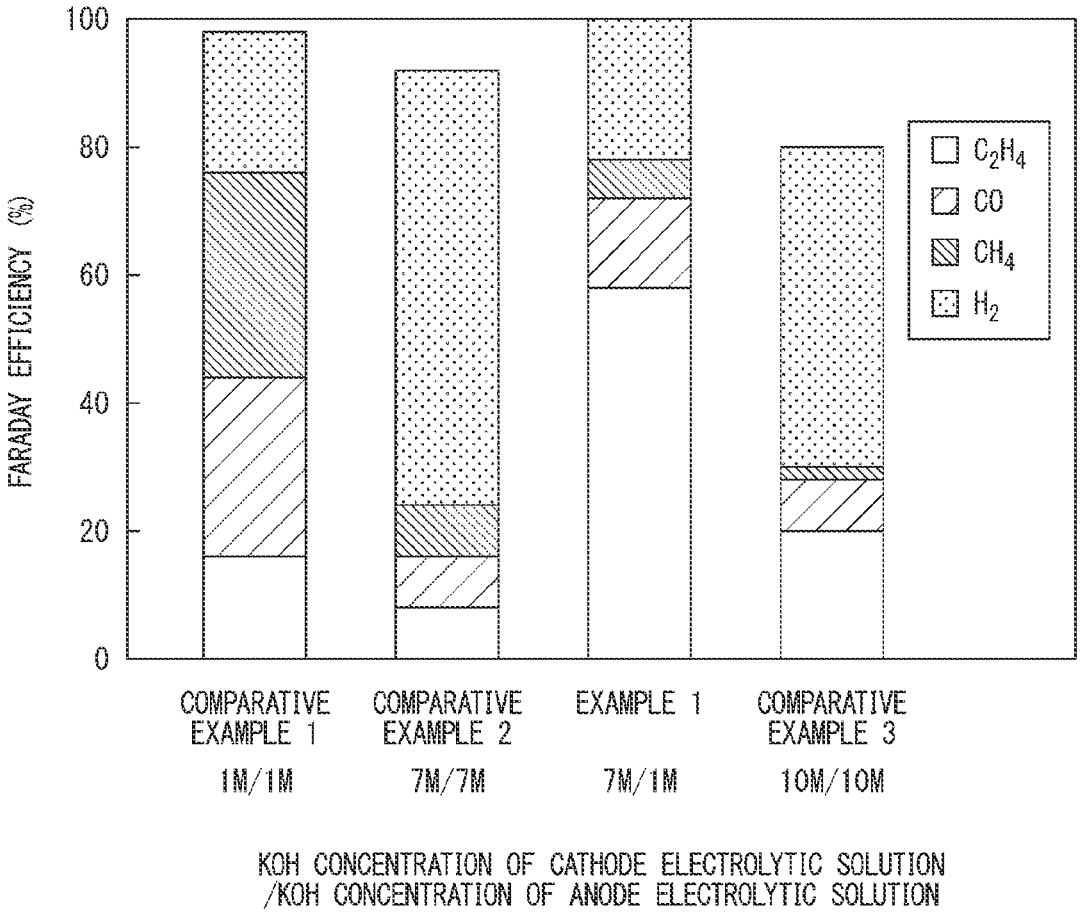
FIG. 5 is a graph showing electrolysis test results according to Examples and Comparative examples.

In the carbon dioxide treatment apparatus 100 shown in FIG. 1, a $CO_2$ electrolysis test was conducted by changing the combination of potassium hydroxide concentration (molar concentration) of each of the cathode side electrolytic solution and the anode side electrolytic solution. The results of the $CO_2$ electrolysis test (Faraday efficiency (%) of ethylene, carbon monoxide, methane and hydrogen) are shown in the graph of FIG. 5.

Example 1

A KOH concentration of the cathode side electrolytic solution was 7 M, and a KOH concentration of the anode side electrolytic solution was 1 M.

Comparative Example 1

The KOH concentration of both the cathode side electrolytic solution and the anode side electrolytic solution was set to 1 M.

Comparative Example 2

The KOH concentration of both the cathode side electrolytic solution and the anode side electrolytic solution was set to 7 M.

Comparative Example 3

The KOH concentration of both the cathode side electrolytic solution and the anode side electrolytic solution was set to 10 M.

<Results>

Example 1 showed the highest ethylene Faraday efficiency. From this, it was found that the $CO_2$ electrolysis efficiency can be improved by making the pH of the electrolytic solution higher than the pH of the anode side electrolytic solution, that is, creating a hydrogen ion concentration gradient.

In Example 1, it is considered that, when the KOH concentration of the anode side electrolytic solution is set to 1 M, the oxygen generation became milder than in a case in which the KOH concentration was 7 M, and the reaction rate balance between the two electrodes was improved. As a result, charge compensation can be achieved without any problem even at the cathode, and it is considered that $CO_2$ electrolysis became the main reaction.

In Comparative example 2, the oxygen generation becomes advantageous, and the cathode becomes rate-determining Therefore, it is thought that an overvoltage is locally applied in a region in which electrons are likely to be supplied when trying to perform the charge compensation at the cathode forcibly, and thus a potential region in which hydrogen generation is advantageous is also shifted.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

EXPLANATION OF REFERENCES

1 Recovery device
2 Electrochemical reaction device
3 Power storage device
4 Carbon increase reaction device
6 Number of carbon atoms
11 Concentration part
12 Absorption part
13 Concentration part
21 Cathode
22 Anode
23 Anion exchange membrane
23*a* Liquid flow path
24 Gas flow path structure
24*a* Gas flow path
25 Gas flow path structure
25*a* Gas flow path
26 Power supply body
27 Power supply body
28 Liquid flow path structure
28*a* Liquid flow path
29 Liquid flow path structure
29*a* Liquid flow path
31 Conversion part
32 Storage part
33 Positive electrode
34 Negative electrode
35 Negative electrode side flow path
36 Positive electrode side flow path
37 Separator
41 Reactor
42 Gas-liquid separator
43 Heat exchanger
50 Cooler

51 pH measuring device
52 pH adjuster
53 pH measuring device
62 Liquid flow path
63 Liquid flow path
64 Liquid flow path
65 Liquid flow path
66 Liquid flow path
66*a* Liquid flow path
66*b* Liquid flow path
69 Circulation flow path
70 Gas flow path
71 Gas flow path
72 Gas flow path
73 Gas flow path
74 Gas flow path
75 Gas flow path
76 Gas flow path
77 Gas flow path
84 Reactor
100 Carbon dioxide treatment apparatus
A Anode side electrolytic solution
B Anode side electrolytic solution
C Cathode side electrolytic solution
D Cathode side electrolytic solution
E Ethylene gas
F Generated gas
G1 Gas
G2 Concentrated gas
G3 Separated gas
G4 Concentrated gas
G5 Concentrated gas
J1 Olefin liquid
J2 Olefin gas
K Heat medium

What is claimed is:

1. A carbon dioxide treatment apparatus comprising:

a recovery device configured to recover carbon dioxide;

an electrochemical reaction device configured to electrochemically reduce carbon dioxide; and a pH adjuster, wherein the recovery device includes an absorption part in which an anode side electrolytic solution composed of an alkaline aqueous solution and carbon dioxide gas are brought into contact with each other so that the carbon dioxide is dissolved and absorbed in the anode side electrolytic solution, and a concentration part that concentrates carbon dioxide, the electrochemical reaction device includes an anode, a cathode, an anion exchange membrane provided between the anode and the cathode, a liquid flow path provided between the anode and the anion exchange membrane and through which the anode side electrolytic solution that has absorbed the carbon dioxide in the absorption part flows, and a liquid flow path provided between the cathode and the anion exchange membrane and through which a cathode side electrolytic solution composed of an alkaline aqueous solution of which a pH has been adjusted by the pH adjuster flows, the pH of the cathode side electrolytic solution being higher than that of the anode side electrolytic solution, and the carbon dioxide gas is supplied from the concentration part to a gas flow path on a side of the cathode opposite to the anode, and the carbon dioxide gas is reduced at the cathode.

2. The carbon dioxide treatment apparatus according to claim 1, further comprising a power storage device configured to supply electric power to the electrochemical reaction device, wherein the power storage device includes a conversion part that converts renewable energy into electrical energy, and a storage part that stores the electrical energy converted by the conversion part.

3. The carbon dioxide treatment apparatus according to claim 2, wherein:

the storage part is a nickel metal hydride battery, the nickel metal hydride battery includes a positive electrode, a negative electrode, a separator provided between the positive electrode and the negative electrode, a positive electrode side flow path provided between the positive electrode and the separator, and a negative electrode side flow path provided between the negative electrode and the separator, when the nickel metal hydride battery is discharged, the anode side electrolytic solution is circulated in an order of the absorption part, the negative electrode side flow path, the electrochemical reaction device, and the absorption part, and when the nickel metal hydride battery is charged, the anode side electrolytic solution is circulated in an order of the absorption part, the negative electrode side flow path, the electrochemical reaction device, the positive electrode side flow path, and the absorption part.

4. The carbon dioxide treatment apparatus according to claim 3, wherein the pH adjuster brings the cathode side electrolytic solution into contact with the carbon dioxide gas.

5. The carbon dioxide treatment apparatus according to claim 3, further comprising a carbon increase reaction device that increases an amount of ethylene generated by reducing carbon dioxide in the electrochemical reaction device and increases the number of carbon atoms.

6. The carbon dioxide treatment apparatus according to claim 5, further comprising a heat exchanger that heats the anode side electrolytic solution by exchanging heat between a heat medium heated by heat due to a reaction in the carbon increase reaction device and the anode side electrolytic solution.

7. The carbon dioxide treatment apparatus according to claim 2, wherein the pH adjuster brings the cathode side electrolytic solution into contact with the carbon dioxide gas.

8. The carbon dioxide treatment apparatus according to claim 2, further comprising a carbon increase reaction device that increases an amount of ethylene generated by reducing carbon dioxide in the electrochemical reaction device and increases the number of carbon atoms.

9. The carbon dioxide treatment apparatus according to claim 8, further comprising a heat exchanger that heats the anode side electrolytic solution by exchanging heat between a heat medium heated by heat due to a reaction in the carbon increase reaction device and the anode side electrolytic solution.

10. The carbon dioxide treatment apparatus according to claim 1, wherein the pH adjuster brings the cathode side electrolytic solution into contact with the carbon dioxide gas.

11. The carbon dioxide treatment apparatus according to claim 10, further comprising a carbon increase reaction device that increases an amount of ethylene generated by reducing carbon dioxide in the electrochemical reaction device and increases the number of carbon atoms.

12. The carbon dioxide treatment apparatus according to claim 11, further comprising a heat exchanger that heats the anode side electrolytic solution by exchanging heat between a heat medium heated by heat due to a reaction in the carbon increase reaction device and the anode side electrolytic solution.

13. The carbon dioxide treatment apparatus according to claim 1, further comprising a carbon increase reaction device that increases an amount of ethylene generated by reducing carbon dioxide in the electrochemical reaction device and increases the number of carbon atoms.

14. The carbon dioxide treatment apparatus according to claim 13, further comprising a heat exchanger that heats the anode side electrolytic solution by exchanging heat between a heat medium heated by heat due to a reaction in the carbon increase reaction device and the anode side electrolytic solution.

15. A carbon dioxide treatment method comprising:

bringing carbon dioxide gas into contact with an anode side electrolytic solution composed of an alkaline aqueous solution so that the carbon dioxide is dissolved and absorbed in the anode side electrolytic solution;

adjusting a pH of a cathode side electrolytic solution to be higher than that of the anode side electrolytic solution; and supplying the cathode side electrolytic solution between a cathode and an anion exchange membrane, supplying the anode side electrolytic solution between an anode and the anion exchange membrane, supplying carbon dioxide gas to a side of the cathode opposite to the anode, and electrochemically reducing the carbon dioxide gas to generate a carbon compound and hydrogen.

16. The carbon dioxide treatment method according to claim 15, wherein, in adjusting the pH of the cathode side electrolytic solution, the cathode side electrolytic solution is brought into contact with carbon dioxide, and the carbon dioxide is dissolved in the cathode side electrolytic solution.

17. A method for producing a carbon compound, wherein the carbon compound in which carbon dioxide is reduced is produced using the carbon dioxide treatment method according to claim 16.

18. The method for producing a carbon compound according to claim 17, further comprising increasing an amount of ethylene generated by reducing the carbon dioxide.

19. A method for producing a carbon compound, wherein the carbon compound in which carbon dioxide is reduced is produced using the carbon dioxide treatment method according to claim 15.

20. The method for producing a carbon compound according to claim 19, further comprising increasing an amount of ethylene generated by reducing the carbon dioxide.

* * * * *